US011549703B2

(12) United States Patent
Haveri et al.

(10) Patent No.: US 11,549,703 B2
(45) Date of Patent: Jan. 10, 2023

(54) VENTILATION SYSTEM AND METHOD

(71) Applicant: Framery Oy, Tampere (FI)

(72) Inventors: Janne Haveri, Tampere (FI); Samu Hällfors, Tampere (FI); Mikko Tamminen, Tampere (FI); Pekka Toivola, Tampere (FI)

(73) Assignee: Framery Oy, Tampere (FI)

( * ) Notice: Subject to any disclaimer, the term of this patent is extended or adjusted under 35 U.S.C. 154(b) by 0 days.

(21) Appl. No.: 16/311,420

(22) PCT Filed: Jun. 2, 2017

(86) PCT No.: PCT/FI2017/050414
§ 371 (c)(1),
(2) Date: Dec. 19, 2018

(87) PCT Pub. No.: WO2018/011462
PCT Pub. Date: Jan. 18, 2018

(65) Prior Publication Data

US 2019/0186765 A1 Jun. 20, 2019

(30) Foreign Application Priority Data

Jul. 13, 2016 (FI) ..... 20165583

(51) Int. Cl.
*F24F 7/013* (2006.01)
*E04B 1/82* (2006.01)
(Continued)

(52) U.S. Cl.
CPC ..... *F24F 7/013* (2013.01); *E04B 1/8218* (2013.01); *F24F 7/025* (2013.01); *F24F 7/06* (2013.01); *F24F 2013/242* (2013.01)

(58) Field of Classification Search
CPC .... F24F 7/013; F24F 7/025; F24F 7/06; F24F 2013/242; E04B 1/8218
(Continued)

(56) References Cited

U.S. PATENT DOCUMENTS 3,302,547 A 2/1967 Wasserman
3,611,907 A 10/1971 Wasserman et al.
(Continued)

FOREIGN PATENT DOCUMENTS

CN 101974953 A 2/2011
EP 0340433 A2 11/1989
(Continued)

OTHER PUBLICATIONS

Finnish Patent and Registration Office, Search Report, U.S. Appl. No. 20/165,583, dated Jan. 17, 2017, 1 page.
(Continued)

*Primary Examiner* — Allen R. B. Schult
(74) *Attorney, Agent, or Firm* — Ziegler IP Law Group, LLC

(57) ABSTRACT

A sound proof space, a ventilation system, and a method of ventilating a soundproof space, the ventilation system including at least one fan positioned at least one air inlet aperture or at least one air outlet aperture for sucking air therethrough and providing an air flow; at least one ventilation aperture for guiding air into the space to be ventilated; at least a first and a seconder air channel. The first and the second air channel are formed respectively into a single layer of a sandwich-type wall, roof or floor structure of the space to be ventilated; and the first and the second air channel are joined at one end thereof to form an indirect air path from the air inlet aperture to the ventilation aperture.

11 Claims, 4 Drawing Sheets

(51) Int. Cl.

| | |
|---|---|
| ***F24F 7/02*** | (2006.01) |
| ***F24F 7/06*** | (2006.01) |
| ***F24F 13/24*** | (2006.01) |

(58) Field of Classification Search
USPC ..... 454/200
See application file for complete search history.

(56) References Cited

U.S. PATENT DOCUMENTS

| | | | | |
|---|---|---|---|---|
| 3,981,378 | A * | 9/1976 | Potter | F01N 1/10 181/252 |
| 5,123,874 | A | 6/1992 | White, III | |
| 6,217,281 | B1 | 4/2001 | Jeng et al. | |
| 2006/0217056 | A1 | 9/2006 | Gomi et al. | |
| 2015/0300671 | A1* | 10/2015 | Coleman | G05B 15/02 700/276 |

FOREIGN PATENT DOCUMENTS

| | | | | |
|---|---|---|---|---|
| FR | 2365758 | A1 | 4/1978 | |
| JP | H0547732 | U | 6/1993 | |
| JP | H06159752 | A | 6/1994 | |
| KR | 101029602 | B1 | 4/2011 | |
| WO | 2010115616 | A1 | 10/2010 | |
| WO | WO-2010115616 | A1 * | 10/2010 | F24F 13/24 |

OTHER PUBLICATIONS

International Search Report, Application No. PCT/FI2017/050414, dated Sep. 28, 2017, 12 pages.
Office Action received for Canadian Patent Application No. CA 3,030,463, dated Feb. 11, 2019, 5 pages.
International Preliminary Report on Patentability and Written Opinion received for International Patent Application No. PCT/FI2017/050414, dated Jan. 15, 2019, 6 pages.
Third Party Observations received for International Patent Application No. PCT/FI2017/050414, dated Nov. 13, 2018, 11 pages.
Japan Patent Office, Notification of Ground of Rejection, Application No. 2021-147245, dated Oct. 14, 2022, 5 pages.

* cited by examiner

VENTILATION SYSTEM AND METHOD

TECHNICAL FIELD

The present application generally relates to soundproof spaces. In particular, but not exclusively, the present application relates to ventilation of soundproof spaces.

BACKGROUND

This section illustrates useful background information without admission of any technique described herein being representative of the state of the art.

Soundproof spaces, such as phone booths or conference rooms, are typically sealed structures requiring an air circulation, or ventilation, system in order to ascertain adequate ventilation and to prevent the temperature from rising unpleasantly high. If the soundproof space is movable, it might not be always be possible to connect it to the ventilation system of the surrounding space, such as an office building.

It is desirable to avoid bulky structures, such as thick walls, in movable soundproof spaces, which makes it difficult to arrange the structures required for a ventilation system. A further challenge is presented by the soundproofing, i.e. the ventilation system should not affect the soundproofing. Furthermore, the ventilation system itself should not produce noise inside the soundproof space or outside of it, which can be challenging, especially in smaller spaces.

The aspects of the disclosed embodiments aim to provide a ventilation system and method for movable soundproof spaces that overcomes or at least mitigates the above-mentioned challenges.

SUMMARY

Various aspects of examples of the disclosed embodiments are set out in the claims.

According to a first example aspect of the present disclosure, there is provided a ventilation system, comprising at least one fan positioned at at least one air inlet aperture or at at least one air outlet aperture for sucking air therethrough and providing an air flow;

at least one ventilation aperture for guiding air into the space to be ventilated; at least a first and a second air channel;

wherein the first and the second air channel are formed respectively into a single layer of a sandwich-type wall, roof or floor structure of the space to be ventilated; and wherein the first and the second air channel are joined at one end thereof to form an indirect air path from the air inlet aperture to the ventilation aperture The ventilation system may further comprise at least a third and a fourth air channel formed respectively into a single layer of a sandwich-type wall, roof or floor structure of the space to be ventilated and joined at one end thereof to form an indirect air path from the space to be ventilated to the air outlet aperture.

The first and the second air channel and/or the third and the fourth air channel, respectively may not overlap in the direction perpendicular to the roof, floor or wall, except at the end thereof where they are joined.

The ventilation system may further comprise at least one further air channel formed respectively into a single layer of the sandwich-type wall, roof or floor structure and joined with the first and the second air channel and/or with the third and the fourth air channel, respectively to form the indirect air path.

The at least one of said air channels may comprise curves or bends in the plane of a layer in which it is formed.

The width of said air channels may be larger than their height.

According to a second example aspect of the present disclosure, there is provided a soundproof space, comprising a sandwich-type roof, wall and/or floor structure comprising at least two sound dampening layers and at least one sound stopping layer; and a ventilation system according to the first example aspect of the present disclosure.

The at least one air inlet aperture and/or the at least one air outlet aperture may be positioned at the roof, the floor or at the lower corners of the soundproof space.

The material of the layers in which the first, the second, the third and/or the fourth air channel are formed may be chosen in such a way that the surface properties thereof do not substantially hinder the air flow in the air channel.

According to a third example aspect of the present disclosure, there is provided a method of ventilating a soundproof-space having a sandwich type wall, roof or floor structure, comprising forming an indirect air path through the wall, roof or floor structure from at least one inlet aperture by forming a first and a second air channel joined at one end thereof and formed respectively into a single layer of the sandwich-type wall, roof or floor structure of the space to be ventilated;

providing an air flow into the indirect air path with at least one fan positioned at the at least one air inlet aperture or at at least one air outlet aperture by sucking air therethrough; and adjusting the air flow so that the amount thereof is large enough and the noise caused by the ventilation does not exceed a desired threshold.

Different non-binding example aspects and embodiments of the present disclosure have been illustrated in the foregoing. The embodiments in the foregoing are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

For a more complete understanding of example embodiments of the present disclosure, reference is now made to the following descriptions taken in connection with the accompanying drawings in which.

DETAILED DESCRIPTON OF THE DRAWINGS

The present disclosure and its potential advantages are understood by referring to FIGS. 1 through 4 of the drawings. In this document, like reference signs denote like parts or steps.

Figure 1:
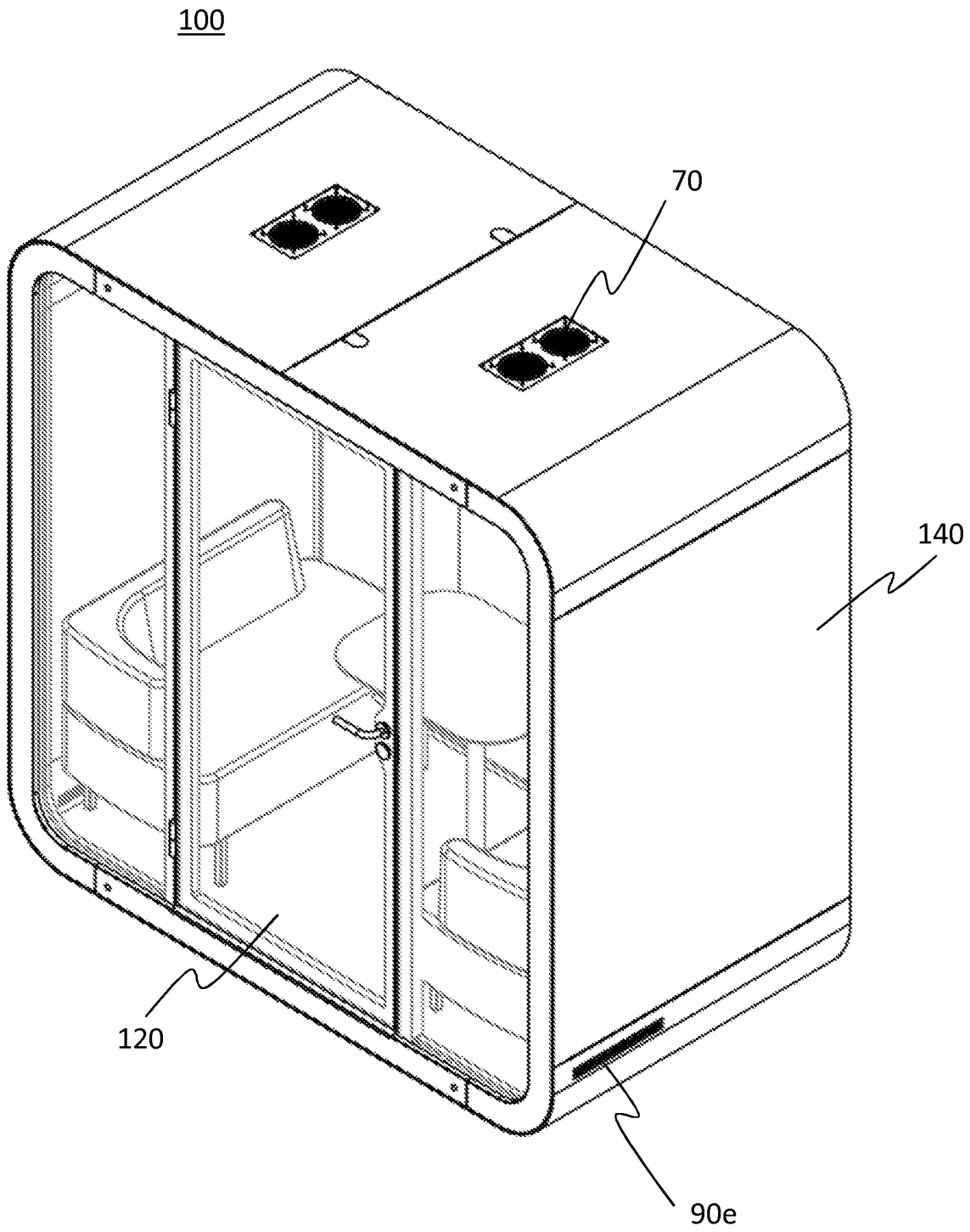
FIG. 1 shows a principle view of a soundproof space, a conference booth, for example in which an embodiment of the present disclosure is used.

FIG. 1 shows a principle view of a soundproof space, in this example a movable conference booth, for example in which an embodiment of the present disclosure is used. The phone booth 100 comprises walls 120 and a door 140. The ventilation system 200 (FIG. 2) and the ventilation method according to an embodiment of the invention is for example used in the conference booth 100. The wall structure of the conference booth 100 is not thick and accordingly, the ventilation system 200 is not bulky. The ventilation system and method according to an embodiment of the present disclosure is further used for example in vehicles, in engine rooms, in temporary housing and other buildings or casings requiring ventilation with low noise levels. FIG. 1 further shows at least one fan of the ventilation system 200 and an air outlet aperture 90*e* which will be described hereinafter with reference to FIGS. 2 and 3.

Figure 2:
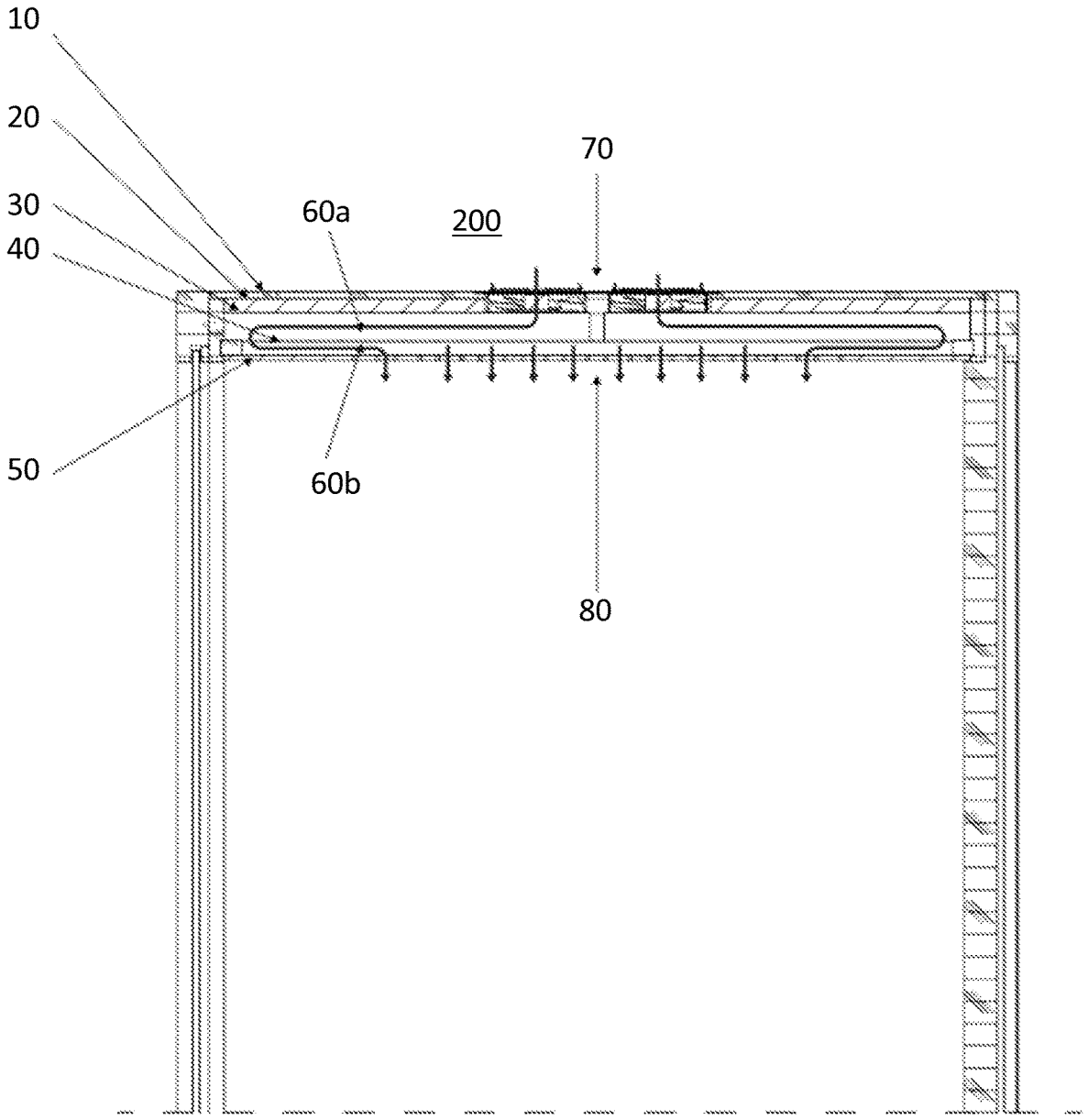
FIG. 2 shows a schematic view of a ventilation system according to an embodiment of the present disclosure.

FIG. 2 shows a schematic view of a ventilation system 200 according to an embodiment of the present disclosure. FIG. 2 shows the wall, or roof, structure in which the ventilation system is arranged. The wall structure is a sandwich-type structure comprising a first layer 10 of sound stopping material 10, for example a layer of metal, a second layer 20 and a third layer 30 of sound dampening material, for example porous or open cell material, a fourth layer 40 of sound stopping material, for example metal, plywood, hardboard, plastic or composite metal, and a fifth layer 50 of sound dampening or acoustic material, for example porous or open cell material. In an embodiment, the fourth layer 40 comprises a steel plate having apertures at the sides thereof.

The ventilation system 200 is arranged into roof structure of the soundproof space. In a further embodiment, the ventilation system is arranged in a wall or floor of the soundproof space, or into a roof of a soundproof space that is not horizontal. In an embodiment, the ventilation system comprises at least one fan 70 for sucking air from outside of the soundproof space through an air inlet aperture and providing an air flow. Although two fans are shown in FIG. 2, the number of fans 70 is not limited thereto. The number of fans, and the type of fans, is chosen in accordance with the situation, i.e. the required amount of air and the required air flow speed and static pressure. Furthermore, the noise produced by the fans must not rise beyond a certain predetermined level. In an embodiment, the ventilation system 200 comprises a control arrangement for adjusting the power of the fans in order to achieve a suitable balance between air flow and noise produced. In a further embodiment, the at least one fan 70 is instead or in addition to being positioned at at least one air inlet aperture for sucking air from the outside of the space, positioned at at least one air outlet aperture for sucking air from inside the soundproof space and providing the air flow.

The ventilation system further comprises at least a first air channel 60*a* and a second air channel 60*b*. The first 60*a* and the second 60*b* air channel are both formed in a single layer of the sandwich-type structure respectively in order to maintain the soundproofing quality of the structure, since the soundproofing material is removed only from a single layer at each position. The first 60*a* and the second 60*b* air channel are joined at one end thereof, for example through an aperture in a sound stopping layer 40, to form an indirect air path through the sandwich-type roof structure. Furthermore, it is to be noted, that the structure of the air channels leading to air outlet apertures, for example near the floor of the soundproof space, is similar to that of the air channels from the inlet apertures as described hereinbefore and hereinafter.

The height of the first 60*a* and the second 60*b* is accordingly limited by the respective layer in which they are formed and their width is chosen in accordance with the required air flow. In an embodiment, the width of the first 60*a* and second 60*b* air channel is substantially larger that the height thereof in order to ascertain an adequate cross-sectional area. In an embodiment, the thickness of the roof is about 100 mm and the thickness of the single layers and therethrough the maximum height of the air channels is 20-40 mm. The material of the layers in which the first 60*a* and the second 60*b* air channel are formed is in an embodiment chosen in such a way that the surface properties thereof do not substantially hinder the air flow in the air channel.

The amount of ventilation is not merely affected by the number and/or power of the fans, as mentioned hereinbefore, but also by the cross-sectional area of the air channels, the length and geometry of the air channels and the position of air inlet and outlet apertures. Furthermore, structures such as grilles or grids or meshes covering the air inlet and outlet apertures affect the amount of ventilation, or air flow.

The ventilation system 200 comprises at least one ventilation aperture 80 for guiding the air into the space to be ventilated, for example into the soundproof space from the first 60*a* and second 60*b* air channel. It is to be noted that the ventilation system 200 shown in FIG. 2 comprises a first 60*a* and a second 60*b* air channel forming an indirect path from the fan to the inside of the soundproof space on both sides of the roof. In an embodiment, the ventilations system comprises just one indirect path formed by the first 60*a* and second 60*b* air channel. In a further embodiment, the ventilation system comprises several indirect paths formed by the first 60*a* and second 60*b* air channel, i.e. the number of indirect air paths is not limited to one or two.

The ventilation system 200 comprises the first 60*a* and second 60*b* air channel forming an indirect air path in order not to compromise the soundproofing of the space. Should the air path be direct through the roof or wall structure sound would travel therethrough relatively easily as well. Since the air path is indirect, i.e. has curves and bends, the sound must travel a longer and indirect way therethrough. Although FIG. 2 shows the indirect air path formed by the first 60*a* and the second 60*b* air channel, in a further embodiment the ventilation system comprises an air path formed by three or more air channels, if the sandwich-type structure has sufficient space for further air channels. Furthermore, the first 60*a* and second 60*b* air channel comprise, in an embodiment, curves or bends also in the plane of the respective layer in which they are formed, i.e. they do not run straight in the plane of the layer. Furthermore, the first 60*a* and second 60*b* air channel are in an embodiment formed in different positions in the plane of the roof, i.e. they do not overlap in the direction perpendicular to the roof, floor or wall, except of course at the position in which they are joined together.

The length of the first 60*a* and second 60*b* air channel is chosen in accordance with the situation so that they are long enough in order not to compromise the soundproofing and short enough so as to be able to provide an adequate ventilation. The amount of ventilation required for a space is, in an embodiment, at least 8 l/s per person. Accordingly, for example in a soundproof space having a volume of 4,8 $m^3$ and having space for four people, the amount of ventilation needed is 32 l/s.

Figure 3:
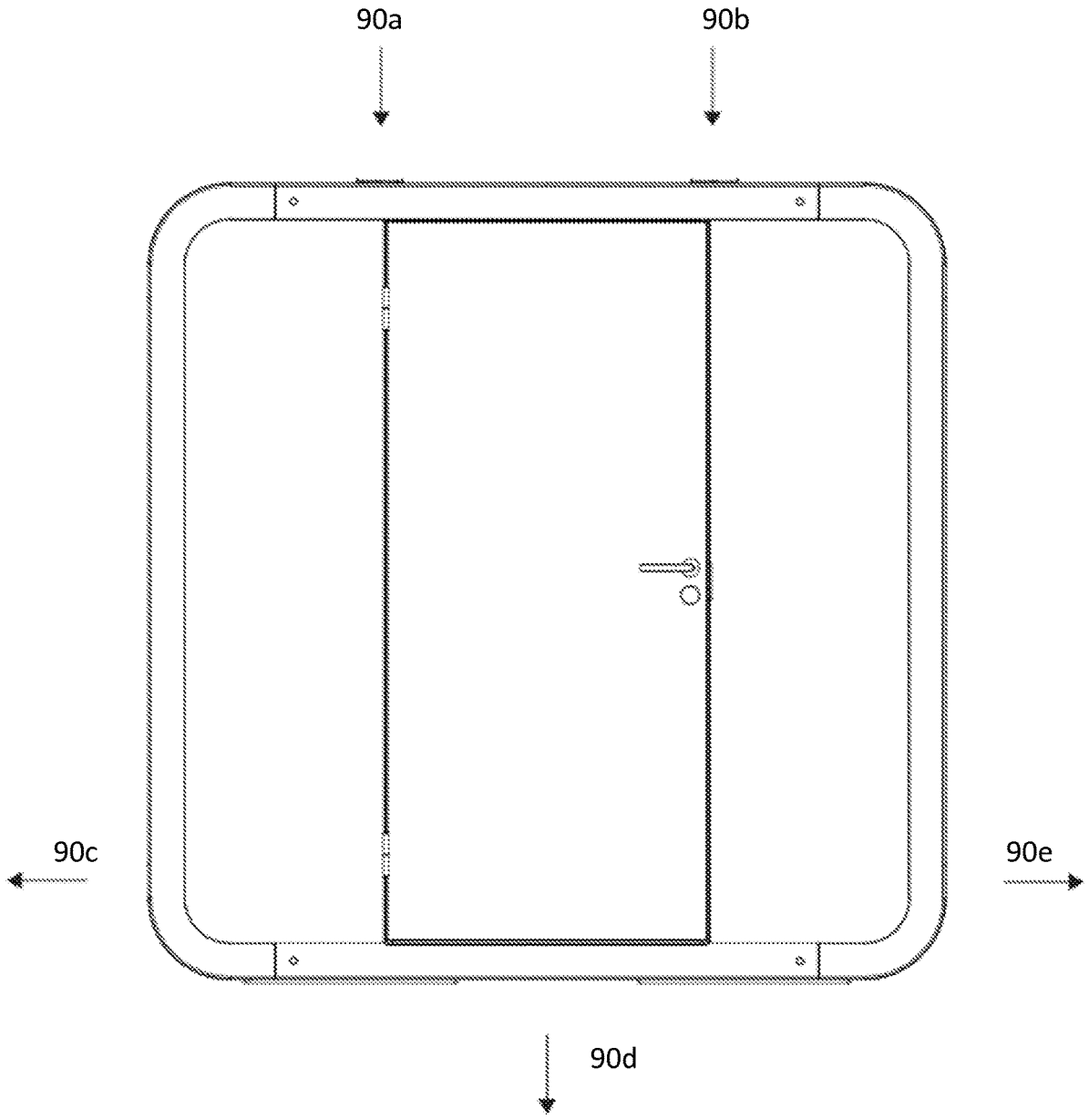
FIG. 3 shows a schematic view of air apertures of a ventilation system according to an embodiment of the present disclosure.

FIG. 3 shows a schematic view of air apertures of a ventilation system 200 according to an embodiment of the present disclosure. The air inlet and outlet apertures are in an embodiment positioned in such a way that they are as far as possible from people in the environment of the soundproof space, for example people working in an office in which the movable soundproof space is in use in order to prevent sound from outside being conveyed in to the soundproof space via the air inlet and outlet apertures and in order for the possible noise of the at least one fan 70 at the air inlet apertures not to disturb the people in the environment of the soundproof space. Appropriate positions for the inlet and outlet apertures are for example the roof, the floor and lower corners of the soundproof space. FIG. 3 shows air inlet apertures 90*a*,90*b* and air outlet apertures 90*c*,90*d*,90*e*. The number of inlet and outlet apertures is not limited to the example shown, but rather the number thereof is chosen in accordance with the situation, starting from one inlet and outlet aperture each. In an embodiment, an indirect air path as hereinbefore described formed by a first channel 60*a* and a second channel 60*b* leads from inlet apertures to a ventilation aperture 80 and an indirect air path as hereinbefore described with reference to at least the first 60*a* and second 60*b* air channels, formed at least by a third and a fourth air channel (not shown) leads from the space to be ventilated to the outlet apertures. In an embodiment, several indirect air paths formed by a first channel 60*a* and a second channel 60*b* lead into the soundproof space from each air inlet aperture 90*a*,90*b* or from one or more of the air inlet apertures 90*a*,90*b*. In an embodiment, several indirect air paths formed by a third channel and a fourth channel lead into each air outlet aperture 90*c*,90*d*,90*e* or to one or more of the air outlet apertures 90*e*,90*d*,90*e* from inside the soundproof space.

Figure 4:
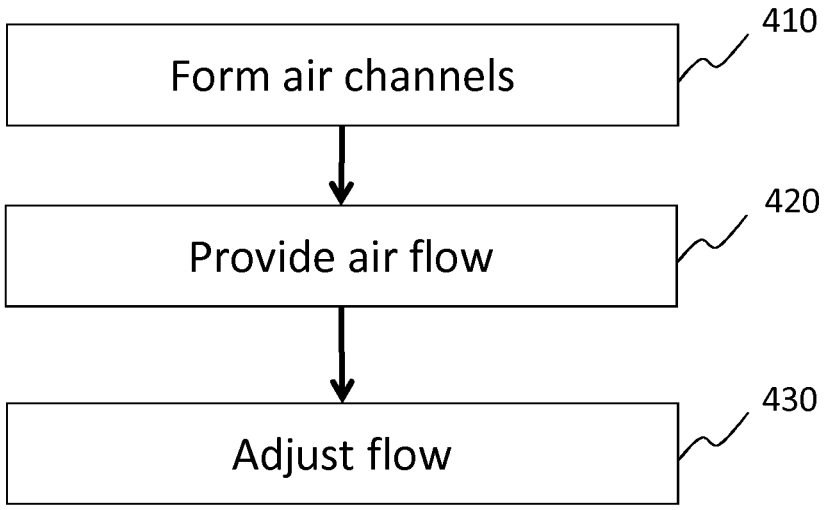
FIG. 4 shows a flow chart of a ventilation method according to an embodiment of the present disclosure.

FIG. 4 shows a flow chart of a ventilation method according to an embodiment of the present disclosure. At step 410 at least a first 60*a* and a second 60*b* air channel is formed into a single layer of a roof, wall or floor structure of a soundproof space as hereinbefore described with reference to FIGS. 1-3 in order to provide an indirect air path through the roof, floor or wall structure. At step 420, an air flow is provided to the indirect air path by sucking air through an inlet aperture 90*a*,90*b* with a fan 70 or by sucking from the inside of the soundproof space through an outlet aperture 90*c*,90*d*,90*e* with a fan 70. At step 430, the air flow is adjusted so that the amount thereof is large enough and the noise caused by the ventilation does not exceed a desired threshold, i.e. the noise does not rise to an uncomfortable level.

Without in any way limiting the scope, interpretation, or application of the claims appearing below, a technical effect of one or more of the embodiments disclosed herein is providing a ventilation system for a movable soundproof space. Another technical effect of one or more of the embodiments disclosed herein is providing a ventilation system without increasing the bulk of the wall or roof structures of a soundproof space. A still further technical effect of one or more of the embodiments disclosed herein is providing a ventilation system for a soundproof space without compromising the soundproofing or causing noise.

Although various aspects of the disclosed embodiments are set out in the independent claims, other aspects of the present disclosure comprise other combinations of features from the described embodiments and/or the dependent claims with the features of the independent claims, and not solely the combinations explicitly set out in the claims.

It is also noted herein that while the foregoing describes example embodiments of the present disclosure, these descriptions should not be viewed in a limiting sense. Rather, there are several variations and modifications which may be made without departing from the scope of the present invention as defined in the appended claims.

The invention claimed is:

1. A ventilation system, comprising:

at least one fan positioned at least one air inlet aperture or at least one air outlet aperture for sucking air therethrough and providing an air flow;

at least one ventilation aperture for guiding air into a space to be ventilated;

at least a first and a second air channel in a sandwich-type wall, roof, or floor of the space to be ventilated, wherein the sandwich-type wall, roof, or floor of the space to be ventilated forms part of the ventilation system and is formed of parallel, substantially wall-wide, roof-wide or floor-wide respective single layers formed of single material layer sheets stacked on top of each other and having an orientation parallel with a predominant plane of the respective wall, roof, or floor, wherein the first air channel is formed into one of the respective single layers of the sandwich-type wall, roof or floor of the space to be ventilated and the second air channel is formed into another one of the respective single layers of the sandwich-type wall, roof or floor of the space to be ventilated; and one end of the first air channel is joined with one end of the second air channel through an aperture in an intervening single layer to form an indirect air path from the at least one air inlet aperture to the at least one ventilation aperture, wherein said intervening single layer is a sound stopping layer.

2. The ventilation system of claim 1, wherein the first and the second air channels do not overlap in a direction perpendicular to the wall, roof, or floor, except at said ends of the first and second air channels where the first air channel and the second air channel are joined.

3. The ventilation system of claim 1, further comprising at least one further air channel, formed into a further one of the single layers of the sandwich-type wall, roof or floor, and joined with the first and the second air channels to form the indirect air path.

4. The ventilation system of claim 1, wherein at least one of said air channels comprises curves or bends in a plane of the single layer in which the at least one of said air channels is formed.

5. The ventilation system of claim 1, wherein a width of said air channels is larger than a height of said air channels.

6. The ventilation system of claim 1, wherein the parallel, substantially wall-wide, roof-wide or floor-wide respective single layers extend continuously from one end of the respective sandwich-type wall, roof, or floor to an opposite end of the respective sandwich-type wall, roof, or floor.

7. A soundproof space, comprising a sandwich-type roof, wall and/or floor formed of parallel, substantially wall-wide, roof-wide or floor-wide respective single layers formed of single material layer sheets stacked on top of each other and having an orientation parallel with a predominant plane of the respective wall, roof, or floor; and wherein at least two of the respective single layers are of porous or open cell material and at least one of the respective single layers is of sound stopping material, the at least one respective single layer of sound stopping material being of metal, plywood, hardboard, plastic or composite metal; and a ventilation system comprising at least one fan positioned at least one air inlet aperture or at least one air outlet aperture for sucking air therethrough and providing an air flow;

at least one ventilation aperture for guiding air into the soundproof space to be ventilated;

at least a first and a second air channel, wherein the first air channel is formed into one of the at least two single layers of porous or open cell material of the sandwich-type wall, roof and/or floor and the second air channel is formed into another one of the at least two single layers of porous or open cell material of the sandwich-type wall, roof and/or floor, wherein the at least one single layer of sound stopping material resides in between the two single layers of porous or open cell material in which the first and second air channels are formed; and one end of the first air channel is joined through an aperture in the at least one single layer of sound stopping material with one end of the second air channel to form an indirect air path from the at least one air inlet aperture to the at least one ventilation aperture.

8. The soundproof space of claim 7, wherein the at least one air inlet aperture and/or the at least one air outlet aperture is positioned at the roof, the floor or at lower corners of the soundproof space.

9. The soundproof space of claim 7, wherein the parallel, substantially wall-wide, roof-wide or floor-wide respective single layers extend continuously from one end of the respective sandwich-type wall, roof, or floor to an opposite end of the respective sandwich-type wall, roof, or floor.

10. A soundproof booth, comprising:

a sandwich-type wall, roof or floor comprising a sound stopping plate sandwiched between a single first sound dampening material layer and a single second sound dampening material layer, the wall, roof or floor further comprising at least one air inlet aperture, and at least one ventilation aperture;

a first air channel, forming at a removed portion of the single first sound dampening material layer and extending along a plane of the single first sound dampening material layer, the first air channel providing a first direction of air flow;

a second air channel, forming at a removed portion of the single second sound dampening material layer and extending along a plane of the single second sound dampening material layer, the second air channel providing a second direction of air flow the second direction being opposite with respect to said first direction; and a fan positioned at the at least one air inlet aperture for sucking air therethrough into the first air channel;

wherein one end of the first air channel is joined through an aperture in the sound stopping plate with one end of the second air channel to form an indirect air path from the at least one air inlet aperture to the at least one ventilation aperture for guiding air into a soundproof space of the soundproof booth to be ventilated via the at least one ventilation aperture; and wherein the sound stopping plate and the single first and second sound dampening material layers are parallel layers each extending to a first end frame of the soundproof booth and to an opposite second end frame of the soundproof booth.

11. The soundproof booth of claim 10, wherein the sound stopping plate extends continuously from the first end frame of the soundproof booth to the opposite second end frame of the soundproof booth.

* * * * *